US012121188B2

(12) United States Patent
Weiss et al.

(10) Patent No.: US 12,121,188 B2
(45) Date of Patent: Oct. 22, 2024

(54) TOILET SEAT ASSEMBLY

(71) Applicant: Bemis Manufacturing Company, Sheboygan Falls, WI (US)

(72) Inventors: Jeffrey J. Weiss, Sheboygan, WI (US); Jonathan Arndt, Sheboygan, WI (US)

(73) Assignee: Bemis Manufacturing Company, Sheboygan Falls, WI (US)

( * ) Notice: Subject to any disclaimer, the term of this patent is extended or adjusted under 35 U.S.C. 154(b) by 27 days.

(21) Appl. No.: 17/869,278

(22) Filed: Jul. 20, 2022

(65) Prior Publication Data

US 2023/0021645 A1 Jan. 26, 2023

Related U.S. Application Data

(60) Provisional application No. 63/223,823, filed on Jul. 20, 2021.

(51) Int. Cl.
*A47K 13/12* (2006.01)

(52) U.S. Cl.
CPC ..... *A47K 13/12* (2013.01)

(58) Field of Classification Search
CPC ..... A47K 13/12; A47K 13/26; A47K 13/24
See application file for complete search history.

(56) References Cited

U.S. PATENT DOCUMENTS 1,354,496 A 10/1920 Leon
D271,417 S 11/1983 Thygesen et al.
D323,027 S 1/1992 Sanders et al.
D348,926 S 7/1994 Rasmussen
D352,995 S 11/1994 Reid et al.
D435,638 S 12/2000 Merry et al.
D437,921 S 2/2001 Hulsebus et al.
D451,177 S 11/2001 Scholpp
(Continued)

FOREIGN PATENT DOCUMENTS

CA 124560 S 9/2008
CN 305377435 10/2019
(Continued)

OTHER PUBLICATIONS

Toto SS114#11 Transitional SoftClose Elongated Toilet Seat, announced Jul. 10, 2007[online], site visited Jul. 13, 2023, <https://www.amazon.com/TOTO-SS 114-11-Transitional-SoftClose/dp/B000TF3OZY> (10 pages).
(Continued)

*Primary Examiner* — Christine J Skubinna
(74) *Attorney, Agent, or Firm* — Michael Best & Friedrich LLP

(57) ABSTRACT

A toilet seat assembly including a toilet seat having a top surface and a bottom surface. The top surface is configured to support a user on a toilet bowl while the bottom surface engages a surface of the toilet bowl. The toilet seat assembly further includes a hinge post coupled to the toilet bowl via a fastener and having an elongated slot defining a longitudinal axis. The toilet seat assembly further includes a hinge assembly pivotably coupling the toilet seat to the hinge post about a pivot axis that is perpendicular to the longitudinal axis. The hinge assembly at least partially overlaps the elongated slot of the hinge post in a direction along the longitudinal axis of the elongated slot.

11 Claims, 10 Drawing Sheets

(56) References Cited

U.S. PATENT DOCUMENTS

| | | | | |
|---|---|---|---|---|
| 6,449,780 | B1 | 9/2002 | Merry | |
| 6,701,539 | B1 | 3/2004 | Hogan | |
| D508,283 | S | 8/2005 | Sutopo | |
| D532,496 | S | 11/2006 | Bates | |
| 7,203,975 | B2 * | 4/2007 | Vierkant, III | A47K 13/26 4/240 |
| D556,308 | S | 11/2007 | Hisey | |
| D557,776 | S | 12/2007 | Delay | |
| D557,777 | S | 12/2007 | Delay | |
| D593,187 | S | 5/2009 | Good et al. | |
| D593,654 | S | 6/2009 | Delay | |
| D593,655 | S | 6/2009 | Delay | |
| D593,656 | S | 6/2009 | De Lay | |
| D596,723 | S | 7/2009 | Dempsey et al. | |
| D653,318 | S | 1/2012 | Torner et al. | |
| D662,192 | S | 6/2012 | Lewis | |
| 8,209,789 | B2 * | 7/2012 | Greenspon | A47K 13/26 4/234 |
| D712,020 | S | 8/2014 | Thorn | |
| D733,851 | S | 7/2015 | Stelter et al. | |
| D745,650 | S | 12/2015 | Buntine | |
| D752,192 | S | 3/2016 | Smith | |
| D858,725 | S | 9/2019 | King | |
| D868,950 | S | 12/2019 | Ross | |
| D894,352 | S | 8/2020 | Lee et al. | |
| D921,862 | S | 6/2021 | Zerndt | |
| 11,564,538 | B2 | 1/2023 | Hand et al. | |
| 2007/0094777 | A1 | 5/2007 | Bryant | |
| 2008/0060120 | A1 * | 3/2008 | Er | A47K 13/12 4/236 |
| 2009/0106884 | A1 | 4/2009 | Bemis et al. | |
| 2012/0023651 | A1 | 2/2012 | Taylor et al. | |
| 2013/0340154 | A1 * | 12/2013 | Hand | A47K 13/12 4/240 |
| 2020/0288926 | A1 * | 9/2020 | Gong | A47K 13/26 |
| 2021/0068597 | A1 * | 3/2021 | Wu | A47K 13/12 |

FOREIGN PATENT DOCUMENTS

| | | |
|---|---|---|
| CN | 306723693 | 7/2021 |
| GB | 8206367000-2000 | 2/2020 |
| KR | 3007075640000 | 9/2013 |
| KR | 3008624930000 | 7/2016 |

OTHER PUBLICATIONS

FealClear Round Toilet Seat with Cover, announced Aug. 26, 2021 [online], site visited Nov. 2, 2022, <https://www.amazon.com/dp/B08SLN63Y4>.

Bath Royale Toilet Seat, announced Nov. 18, 2016 [online], site visited Nov. 2, 2022, <https://www.amazon.com/Elongated-BR606-02-Replacement-including-American/dp/B01NA7J27R>.

* cited by examiner

TOILET SEAT ASSEMBLY

CROSS-REFERENCE TO RELATED APPLICATIONS

This application claims benefit to, prior-filed U.S. Provisional Patent Application No. 63/223,823, filed on Jul. 20, 2021, the entire contents of which are incorporated by reference herein.

FIELD OF THE DISCLOSURE

The present disclosure relates to a toilet seat assembly including a toilet seat and a toilet seat lid pivotably coupled to at least one hinge post.

SUMMARY

In one aspect, a toilet seat assembly includes a toilet seat having a top surface and a bottom surface. The top surface is configured to support a user on a toilet bowl while the bottom surface engages a surface of the toilet bowl. The toilet seat assembly further includes a hinge post coupled to the toilet bowl via a fastener and having an elongated slot defining a longitudinal axis. The toilet seat assembly further includes a hinge assembly pivotably coupling the toilet seat to the hinge post about a pivot axis that is perpendicular to the longitudinal axis. The hinge assembly at least partially overlaps the elongated slot of the hinge post in a direction along the longitudinal axis of the elongated slot.

In yet another aspect, a toilet seat assembly includes a toilet seat and a hinge post configured to pivotably support the toilet seat relative to a toilet bowl. The hinge post includes a base having an elongated slot configured to receive a fastener to couple the hinge post to a toilet bowl. The hinge post also includes a cover movably coupled to the base by a first living hinge. The cover includes a first portion, a second portion, and a second living hinge positioned between the first and second portions. The first portion is coupled to the base by the first living hinge. The second living hinge enables the first and second portions of the cover to move relative to each other. The cover selectively covers the aperture in response to moving the cover about the first living hinge and the second living hinge.

In another aspect, a toilet seat assembly includes a toilet seat configured to move about a pivot axis. The toilet seat includes a top surface, a bottom surface, an inner edge positioned between the top surface and the bottom surface, and an outer edge positioned between the top surface and the bottom surface. The inner edge defines a central opening of the toilet seat and has a front apex, a rear apex, and side apexes. The outer edge has a front apex and side apexes. The toilet seat has an inner maximum length measured perpendicular to the pivot axis between the front apex of the inner edge and the rear apex of the inner edge. The toilet seat has an inner maximum width measured parallel to the pivot axis between the side apexes of the inner edge. The toilet seat has an outer maximum length measured perpendicular to the pivot axis between the front apex of the outer edge and the pivot axis. The toilet seat has an outer maximum width measured parallel to the pivot axis between the side apexes of the outer edge. A ratio of the inner maximum length to the inner maximum width is between 1.24 and 1.34. A ratio of the outer maximum length to the outer maximum width is between 1.13 and 1.18

Other aspects of the disclosure will become apparent by consideration of the detailed description and accompanying drawings.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. Terms of degree, such as "substantially," "about," "approximately," etc. are understood by those of ordinary skill to refer to reasonable ranges outside of the given value, for example, general tolerances associated with manufacturing, assembly, and use of the described embodiments.

Figure 1:
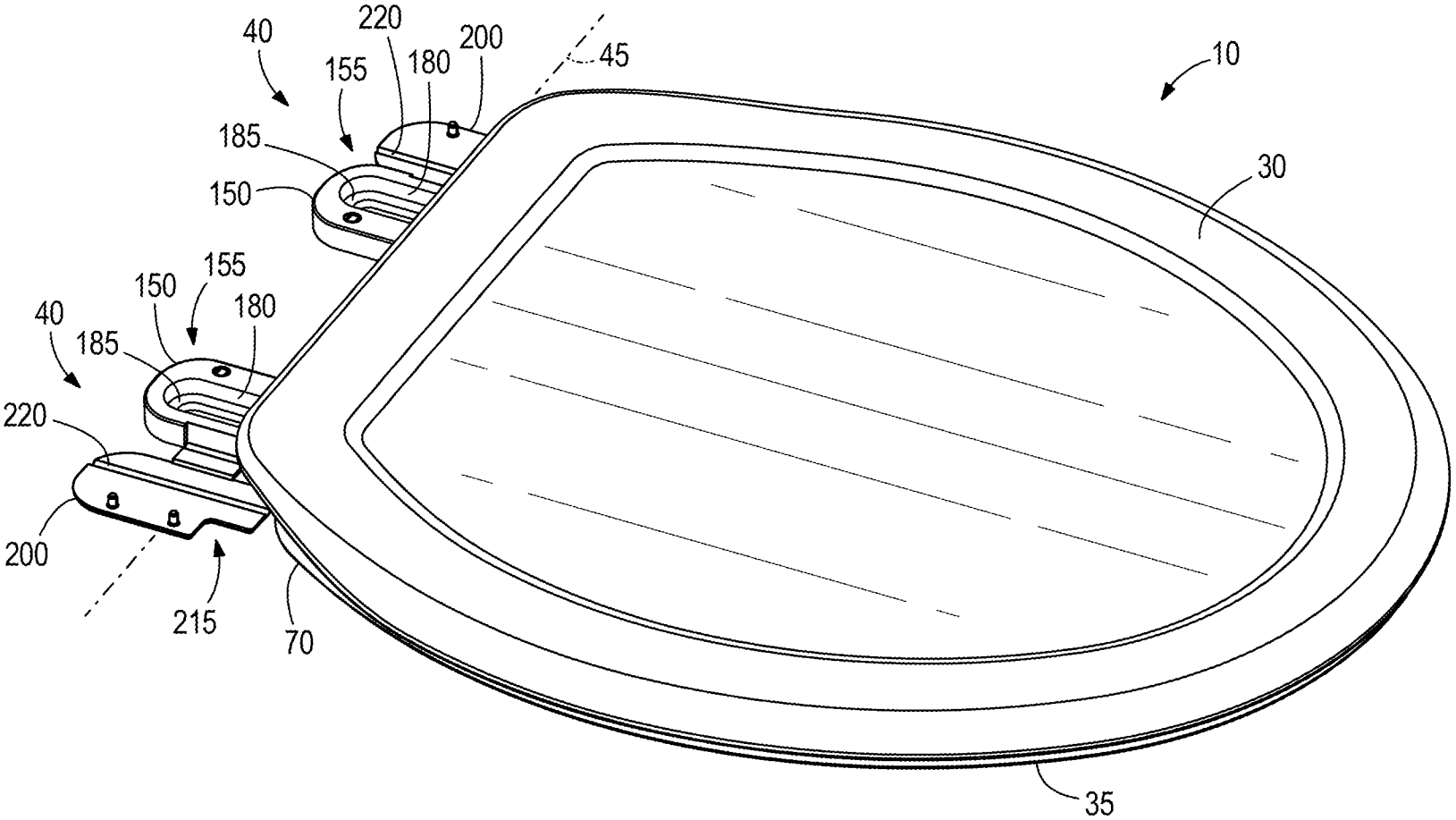
FIG. 1 is a top perspective view of a toilet seat assembly including a toilet seat lid, a toilet seat, and hinge posts.
Figure 2:
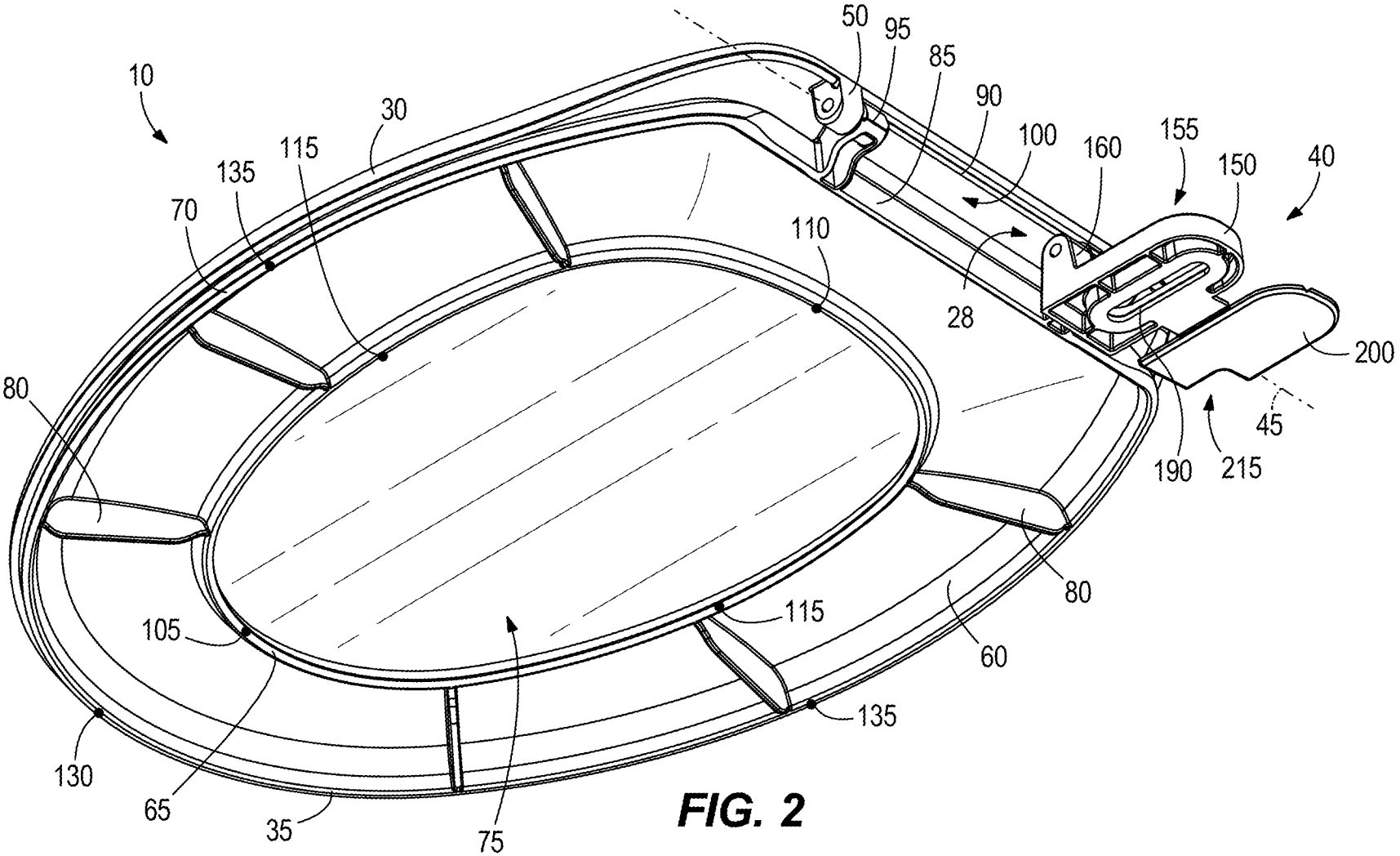
FIG. 2 is a bottom perspective view of the toilet seat assembly of FIG. 1 with one of the hinge posts removed.
Figure 3:
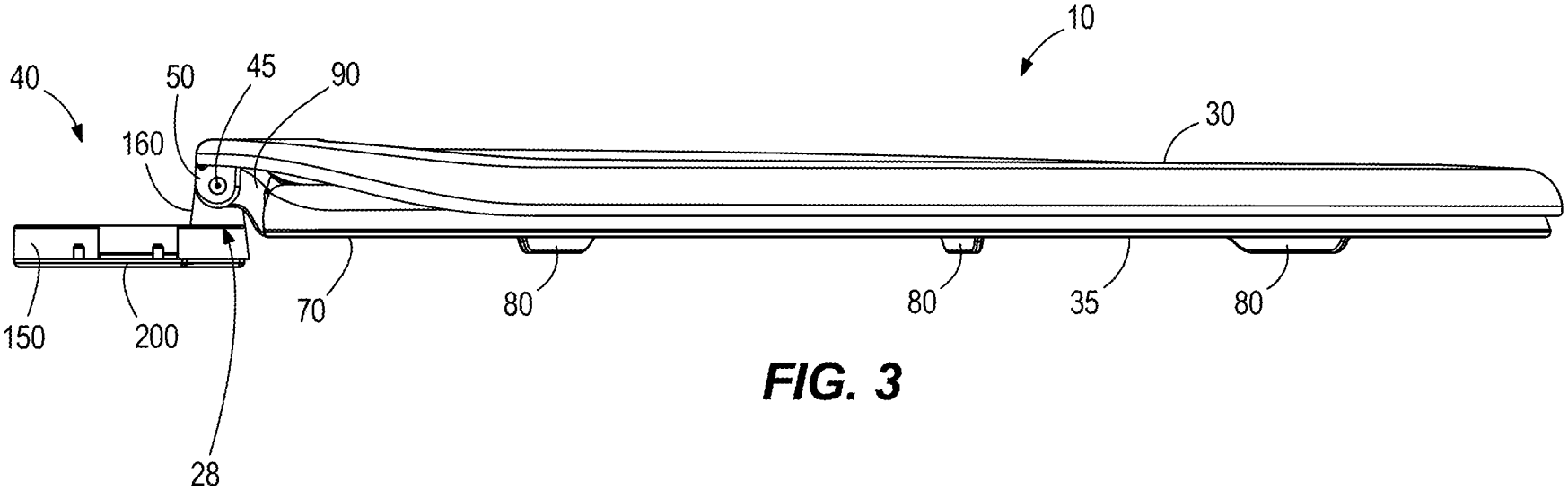
FIG. 3 is a side view of the toilet seat assembly of FIG. 1.
Figure 7:
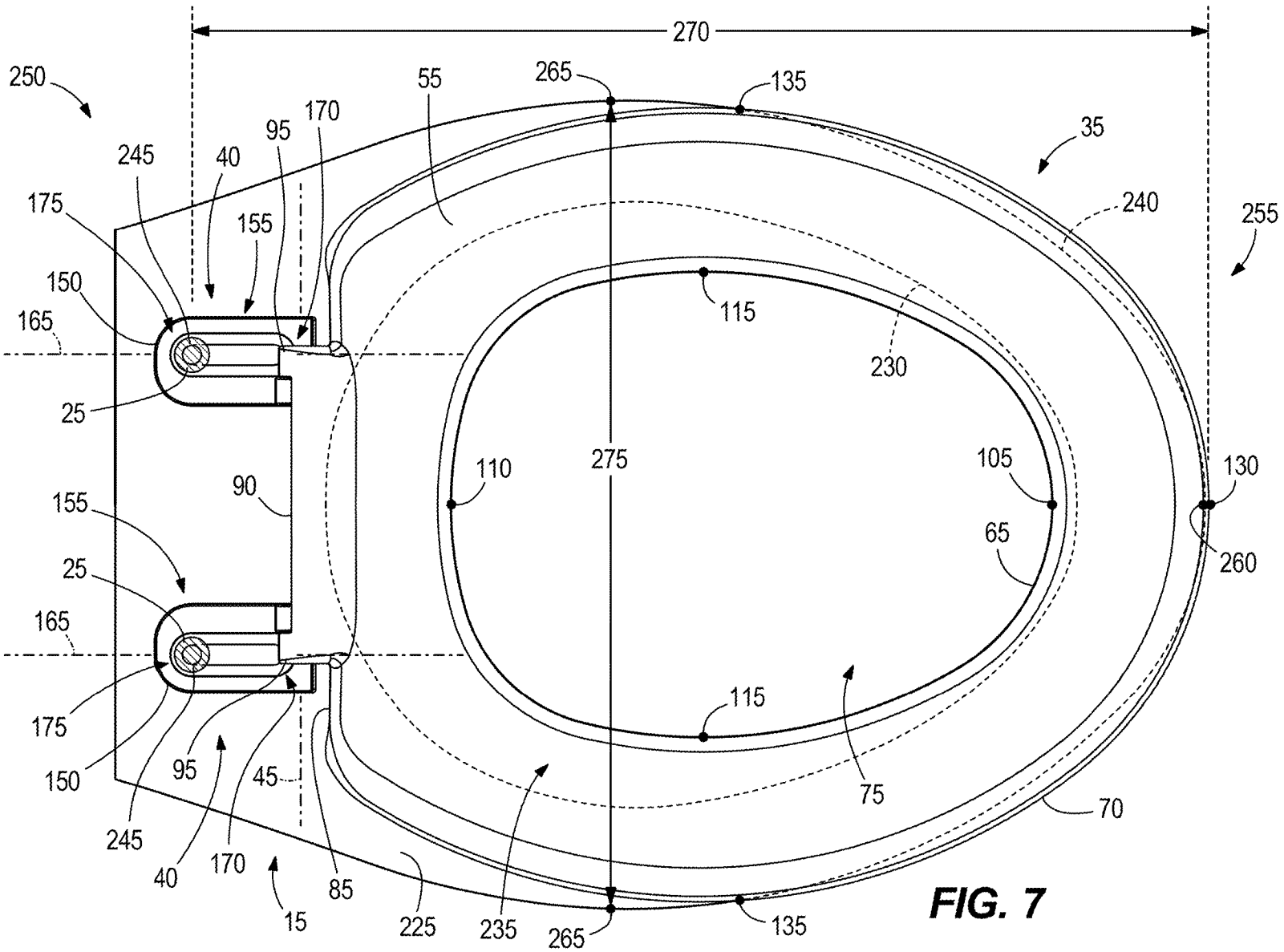
FIG. 7 is a top view of the toilet seat and the hinge posts of FIG. 1 coupled to an elongated toilet bowl.
Figure 8:
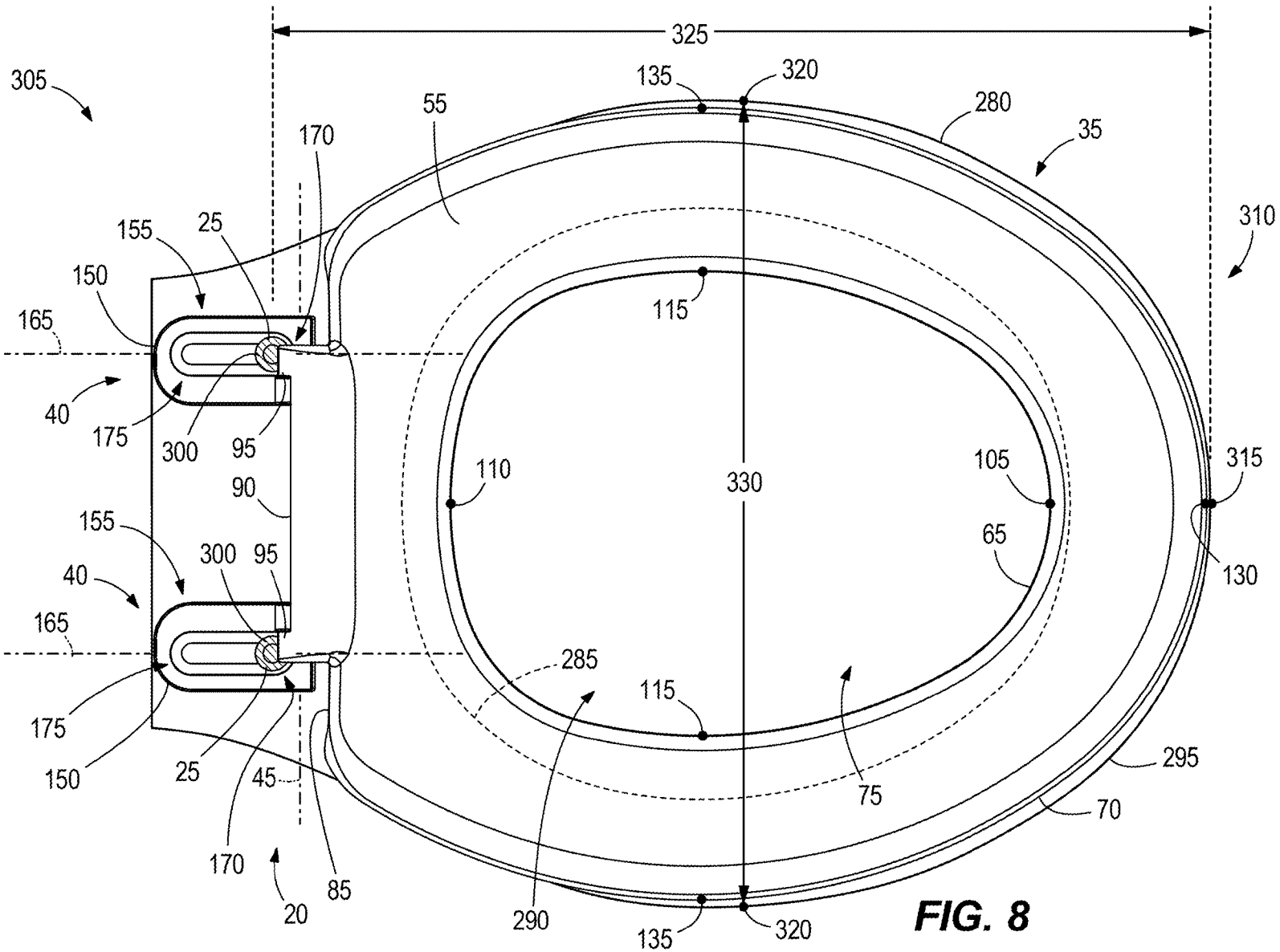
FIG. 8 is a top view of the toilet seat and the hinge posts of FIG. 1 coupled to a round toilet bowl.

FIG. 1 illustrates a toilet seat assembly 10 selectively coupled to either a conventional elongated toilet bowl 15 (FIG. 7) or a conventional round toilet bowl 20 (FIG. 8) by fasteners 25 (FIGS. 7 and 8). With reference to FIGS. 1-3, the illustrated toilet seat assembly 10 includes a hinge assembly 28 that rotatably couples a toilet seat lid 30 and a toilet seat 35 to hinge posts 40 about a pivot axis 45. As such, the hinge assembly 28 includes the toilet seat lid 30, the toilet seat 35, and the hinge posts 40. In the illustrated embodiment, the toilet seat assembly 10 includes two hinge posts 40, but in other embodiments, the toilet seat assembly 10 can include one hinge post (e.g., a platform-style hinge post). The illustrated toilet seat lid 30 includes two attachment arms 50 (one of which is shown in FIG. 2) extending from a bottom surface of the toilet seat lid 30. The attachment arms 50 are coupled to the toilet seat 35, which in turn is coupled to the hinge posts 40, to enable the toilet seat lid 30 to pivot about the pivot axis 45. In other embodiments, the toilet seat lid 30 can include one attachment arm 50 to pivotably couple the toilet seat lid 30 to the hinge posts 40 (e.g., the attachment arm 50 is positioned between the hinge posts 40).

Figure 4:
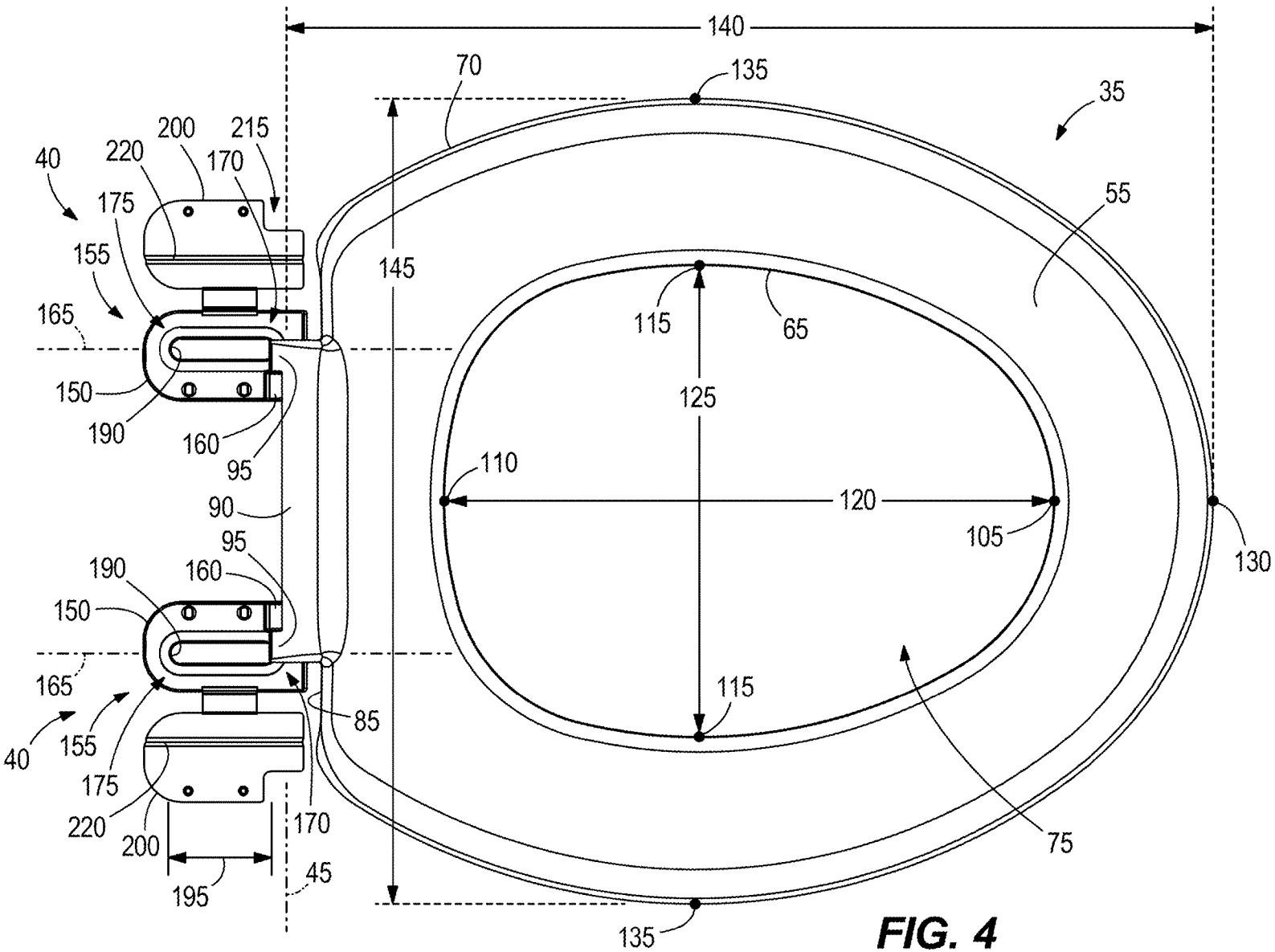
FIG. 4 is a top view of the toilet seat and hinge posts of FIG. 1.
Figure 5:
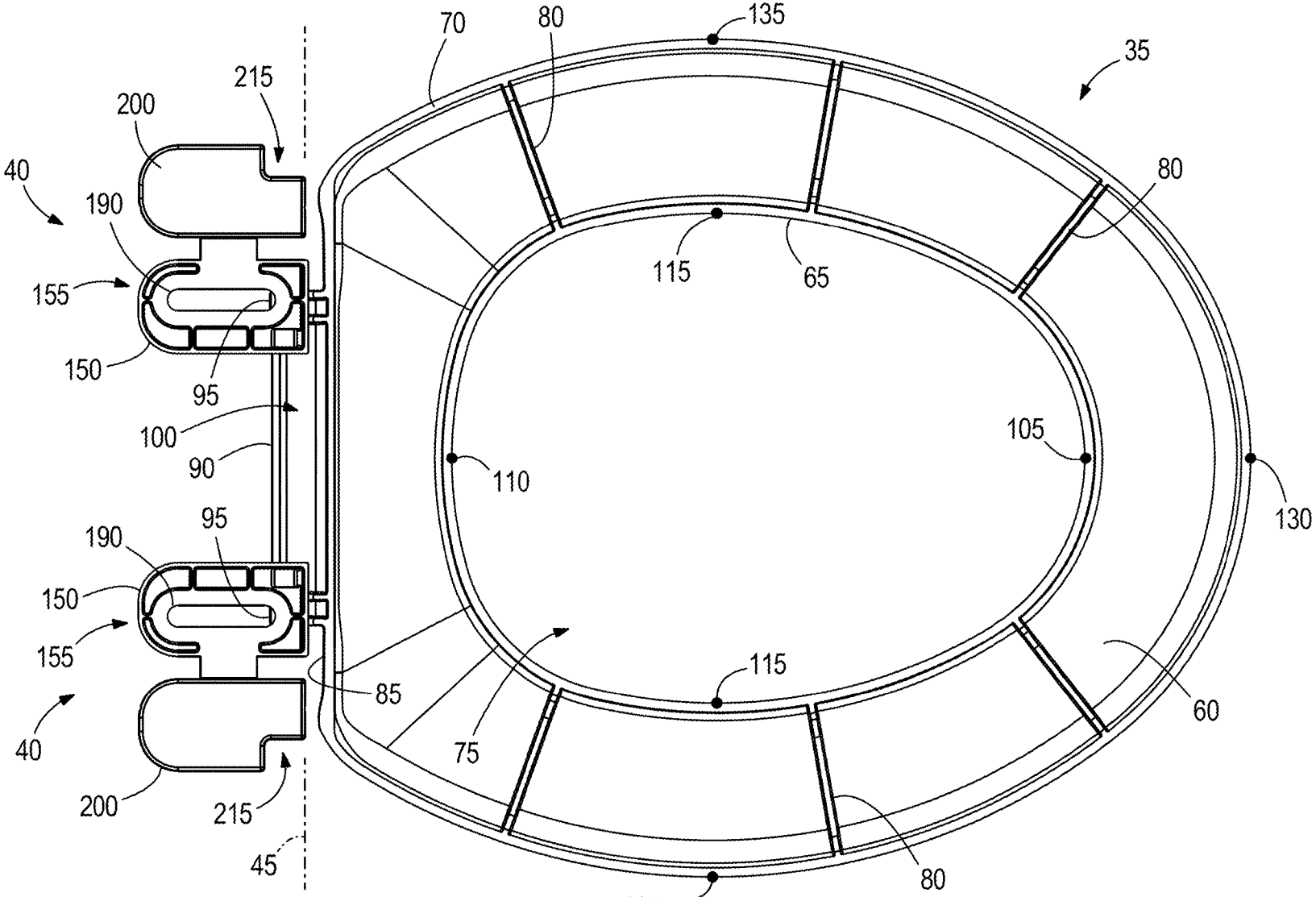
FIG. 5 is a bottom view of the toilet seat and hinge posts of FIG. 1.

With reference to FIGS. 4 and 5, the toilet seat 35 includes a top surface 55 that supports a user on the toilet seat 35 and a bottom surface 60 that engages the toilet bowl 15, 20 when the toilet seat 35 is in an in-use position (e.g., a lowered position). The toilet seat 35 also includes an inner edge 65 and an outer edge 70 positioned at an interface between the top surface 55 and the bottom surface 60. The inner edge 65 defines a central opening 75 of the toilet seat 35. In the illustrated embodiment, the central opening 75 is egg-shaped. The bottom surface 60 includes structural members (e.g., webs 80) that radially extend between the inner edge 65 and the outer edge 70 and provide structural rigidity to the toilet seat 35 (e.g., inhibits the toilet seat 35 from substantially flexing during use). In addition, the toilet seat 35 includes a rear flat surface 85 partially defining the outer edge 70. The hinge assembly 28 includes an attachment portion 90 extending from the rear flat surface 85 and is coupled to the hinge posts 40 enabling the toilet seat 35 to pivot about the pivot axis 45. In particular, the attachment portion 90 includes two attachment arms 95 coupled to the hinge posts 40 and a cavity 100 positioned between the attachment arms 95 such that portions of the hinge posts 40 are received in the cavity 100 (FIG. 6).

As shown in FIG. 4, the inner edge 65 has a front apex 105, a rear apex 110, and side apexes 115. A maximum dimension of the inner edge 65 perpendicular to the pivot axis 45 (e.g., a maximum length 120 of the central opening 75) is measured between the front apex 105 and the rear apex 110. In the illustrated embodiment, the maximum length 120 is about 11.00 inches. In other embodiments, the maximum length 120 is between about 10.87 inches and about 11.13 inches. In addition, a maximum dimension of the inner edge 65 parallel to the pivot axis 45 (e.g., a maximum width 125 of the central opening 75) is measured between the side apexes 115. In the illustrated embodiment, the maximum width 125 is about 8.50 inches. In other embodiments, the maximum width 125 is between about 8.25 inches and about 8.75 inches. Accordingly, a ratio of the maximum length 120 to the maximum width 125 is between about 1.24 and about 1.35.

With continued reference to FIG. 4, the outer edge 70 has a front apex 130 and side apexes 135. A maximum dimension of the toilet seat 35 perpendicular to the pivot axis 45 (e.g., a maximum length 140) is measured between the front apex 130 and the pivot axis 45. In the illustrated embodiment, the maximum length 140 is about 16.80 inches. In other embodiments, the maximum length 140 is between about 16.55 inches and about 17.05 inches. In addition, a maximum dimension of the outer edge 70 parallel to the pivot axis 45 (e.g., a maximum width 145 of the toilet seat 35) is measured between the side apexes 135. In the illustrated embodiment, the maximum width 145 is about 14.57 inches. In other embodiments, the maximum width 145 is between about 14.44 inches and about 14.70 inches. Accordingly, a ratio of the maximum length 140 to the maximum width 145 is between about 1.13 and about 1.18. In addition, a ratio of the maximum length 140 of the toilet seat 35 to the maximum length 120 of the central opening 75 is between about 1.49 and about 1.57. A ratio of the maximum width 145 of the toilet seat 35 to the maximum width 125 of the central opening 75 is between about 1.65 and about 1.78.

Figure 6:
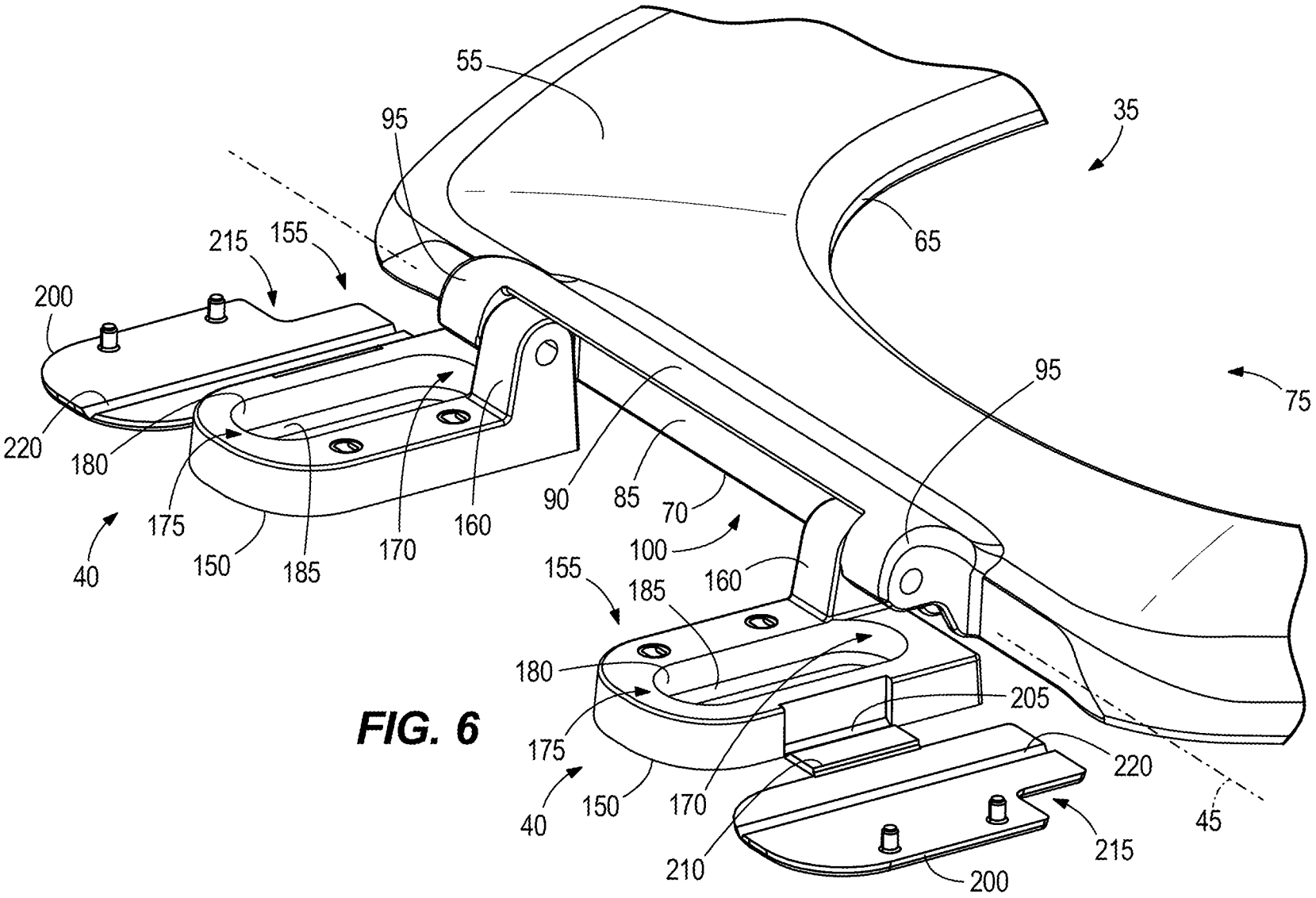
FIG. 6 is a perspective view of the hinge posts and a portion of the toilet seat of FIG. 1.

With reference to FIGS. 4-6, each hinge post 40 includes a base 150 having an elongated aperture 155 (e.g., an elongated slot) and an upright portion 160 extending from the base 150. Each upright portion 160 is part of the hinge assembly 28 and is positioned on one side of an elongated aperture 155. At least a portion of each upright portion 160 is received within the cavity 100 of the attachment portion 90 of the toilet seat 35. In other embodiments, the attachment arms 95 of the toilet seat 35 can be positioned between the upright portions 160 of the hinge posts 40—rather than outboard sides of the upright portions 160 as illustrated—to couple the toilet seat 35 to the hinge posts 40. Each illustrated elongated aperture 155 defines a longitudinal axis 165 perpendicular to the pivot axis 45 extending between a front portion 170 and a rear portion 175 of the elongated aperture 155 (FIG. 4). In addition, each illustrated elongated aperture 155 includes a counterbore portion 180 that extends into the base 150 to a ledge 185 and a through aperture 190 that extends from the ledge 185 through a bottom of the base 150. As shown in FIG. 4, each through aperture 190 has a maximum length 195 parallel to its longitudinal axis 165 extending between the front portion 170 and the rear portion 175. In the illustrated embodiment, the maximum length 195 is about 1.5 inches. In other embodiments, the maximum length 195 is between about 1.37 inches and about 1.63 inches. Accordingly, a ratio of the maximum length 120 of the central opening 75 to the maximum length 195 of the through apertures 190 is between about 6.67 and about 8.12. In addition, a ratio of the maximum length 140 of the toilet seat 35 to the maximum length 195 of the through apertures 190 is between about 10.15 and about 12.45.

The toilet seat 35 is coupled to the hinge posts 40 such that the attachment arms 95 generally align with the elongated apertures 155. For example, the longitudinal axis 165 of each elongated aperture 155 aligns with an attachment arm 95 of the toilet seat 35. In addition, the toilet seat 35 is coupled to the hinge posts 40 such that a portion of the hinge assembly 28 overlaps with the elongated apertures 155 in a direction parallel to the longitudinal axes 165. In particular, in this embodiment, the attachment arms 95 of the toilet seat 35 overlap with the through apertures 190 of the hinge posts 40 in a direction parallel to the longitudinal axes 165. Stated another way, a portion of the elongated apertures 155 are positioned directly below the hinge assembly 28, and more particularly, the attachment arm 95 of the toilet seat 35 at least when the toilet seat 35 is in the lowered position on the toilet bowl 15, 20 (when viewed from above as shown in FIGS. 7 and 8).

As shown in FIG. 6, each hinge post 40 includes a cover 200 that is movably coupled to the base 150 by a first living hinge joint 205 and a second living hinge joint 210 to selectively cover the elongated aperture 155. An extension tab 212 is positioned between the first and second living hinge joints 205, 210. In some embodiments, the cover 200 may be coupled to the base 150 by a single living hinge joint. Alternatively, the cover 200 may be movably coupled to the base 150 by other types of hinges. The cover 200 includes a notch 215 and a third living hinge joint 220. The illustrated third living hinge joint 220 is substantially parallel to the longitudinal axis 165 of the corresponding elongated aperture 155 and extends an entire length of the cover 200. As a result, a first portion of the cover 200 (e.g., the portion coupled to the second living hinge joint 210) is allowed to easily bend or flex relative to a second portion of the cover 200 (e.g., the portion including the notch 215) via the third living hinge joint 220. The cover 200 is positioned relative to the base 150 such that a front portion of the cover 200 overlaps with the hinge assembly 28, and more particularly, the attachment arms 50 of the lid 30 and the attachment arms 95 of the toilet seat 35 in a direction parallel to the longitudinal axes 165. As the attachment arms 50 of the lid 30 and the attachment arms 95 of the toilet seat 35 overlap with the bases 150 in a direction along the longitudinal axes 165, the covers 200 cannot simply pivot relative to its base 150 about the first and second living hinge joints 205, 210 to cover its elongated aperture 155 without interfering with the hinge assembly 28 of the lid 30 and/or the toilet seat 35. Accordingly, the covers 200 are bendable at the third living hinge joint 220 to provide enough clearance between the covers 200, the attachment arms 50 of the lid 30, and the attachment arms 95 of the toilet seat 35 as the covers 200 move about their first and second living hinge joints 205, 210 to cover their elongated apertures 155. The illustrated notches 215 receive the upright portions 160 when the covers 200 are in a closed position to cover the elongated apertures 155. Conversely, the covers 200 are bendable at the third living hinge joint 220 to provide enough clearance between the cover 200, the attachment arms 50 of the lid 30, and the attachment arms 95 of the toilet seat 35 as the covers 200 move about the first and second living hinge joints 205, 210 to uncover the elongated apertures 155. In other embodiments, the third living hinge joints 220 can be substantially perpendicular to the longitudinal axis 165 or obliquely oriented relative to the longitudinal axis 165.

With reference to FIG. 7, the elongated toilet bowl 15 includes an upper surface 225 that supports the toilet seat assembly 10 when coupled to the elongated toilet bowl 15. The upper surface 225 includes an inner edge 230 defining a central opening 235 of the elongated toilet bowl 15 and an outer edge 240. The elongated toilet bowl 15 also includes mounting apertures 245 extending through the upper surface 225 adjacent a rear 250 of the elongated toilet bowl 15 opposite a front 255 of the elongated toilet bowl 15. The outer edge 240 has a front apex 260 and side apexes 265. A maximum dimension of the elongated toilet bowl 15 perpendicular to the pivot axis 45 when the toilet seat assembly 10 is coupled to the elongated toilet bowl 15 (e.g., a maximum length 270) is measured between the front apex 260 and the mounting apertures 245 (e.g., a central axis of the mounting apertures 245). In the illustrated embodiment, the maximum length 270 is about 18.84 inches. In other embodiments, the maximum length 270 is between about 18.34 inches and about 19.34 inches. In addition, a maximum dimension of the outer edge 240 parallel to the pivot axis 45 when the toilet seat assembly 10 is coupled to the elongated toilet bowl 15 (e.g., a maximum width 275) is measured between the side apexes 265. In the illustrated embodiment, the maximum width 275 is about 14.84 inches. In other embodiments, the maximum width 275 is between about 14.59 inches and about 15.09 inches. Accordingly, a ratio of the maximum length 270 to the maximum width 275 is between about 1.21 and about 1.33.

With reference to FIG. 8, the round toilet bowl 20 includes an upper surface 280 that supports the toilet seat assembly 10 when coupled to the round toilet bowl 20. The upper surface 280 includes an inner edge 285 defining a central opening 290 of the round toilet bowl 20 and an outer edge 295. The round toilet bowl 20 also includes mounting apertures 300 extending through the upper surface 280 adjacent a rear 305 of the round toilet bowl 20 opposite a front 310 of the round toilet bowl 20. The outer edge 295 has a front apex 315 and side apexes 320. A maximum dimension of the round toilet bowl 20 perpendicular to the pivot axis 45 when the toilet seat assembly 10 is coupled to the round toilet bowl 20 (e.g., a maximum length 325) is measured between the front apex 315 and the mounting apertures 300 (e.g., a central axis of the mounting apertures 300). In the illustrated embodiment, the maximum length 325 is about 17.34 inches. In other embodiments, the maximum length 325 is between about 16.84 inches and about 17.84 inches. In addition, a maximum dimension of the outer edge 295 parallel to the pivot axis 45 when the toilet seat assembly 10 is coupled to the round toilet bowl 20 (e.g., a maximum width 330) is measured between the side apexes 320. In the illustrated embodiment, the maximum width 330 is about 14.88 inches. In other embodiments, the maximum width 330 is between about 14.63 inches and about 15.13 inches. Accordingly, a ratio of the maximum length 325 to the maximum width 330 is between about 1.11 and about 1.22.

During assembly, the toilet seat assembly 10 can be positioned on the upper surface 225, 280 of either the elongated toilet bowl 15 or the round toilet bowl 20 to align the hinge posts 40 with the mounting apertures 245, 300. Thereafter, the fasteners 25 can be inserted through the elongated apertures 155 and the mounting apertures 245, 300 to couple the toilet seat assembly 10 to either the elongated toilet bowl 15 or the round toilet bowl 20. The illustrated elongated apertures 155 of the hinge posts 40 allow for adjustment of the toilet seat assembly 10 relative to the toilet bowl 15, 20 to best position the toilet seat 35 relative to the different shaped toilet bowls 15, 20. As such, before the fasteners 25 are fully tightened to fix the hinge posts 40 to the toilet bowl 15, 20, the hinge posts 40 can slide on the upper surface 225, 280 to best locate the toilet seat 35.

For example, when the toilet seat assembly 10 is coupled to the elongated toilet bowl 15 (FIG. 7), the toilet seat 35 is slidable in a direction parallel to the longitudinal axes 165 of the elongated apertures 155 to position the fasteners 25 adjacent the rear portions 175 of the elongated apertures 155. In this configuration, the central opening 75 of the toilet seat 35 is completely inboard of the central opening 235 of the elongated toilet bowl 15. In other words, the apexes 105, 110, 115 of the inner edge 65 of the toilet seat 35 are positioned within the inner edge 230 of the elongated toilet bowl 15 when viewed in the reference frame of FIG. 7. In addition, the front apex 130 of the outer edge 70 of the toilet seat 35 is positioned slightly forward of the front apex 260 of the outer edge 240 of the elongated toilet bowl 15, and the side apexes 135 of the outer edge 70 of the toilet seat 35 are positioned forward of the side apexes 265 of the elongated toilet bowl 15 in a direction along the longitudinal axes 165. As such, the toilet seat 35 completely covers the front 255 of the elongated toilet bowl 15 when viewed in the reference frame of FIG. 7. In other embodiments, the front apex 130 of the outer edge 70 of the toilet seat 35 can be positioned behind the front apex 260 of the outer edge 240 of the elongated toilet bowl 15 by sliding the toilet seat 35 and the hinge posts 40 relative to the fasteners 25 toward the rear 250 of the elongated toilet bowl 15. In addition, the hinge posts 40 are sized such that no portion of the hinge posts 40 extends over the central opening 235 of the elongated toilet bowl 15 when the fasteners 25 are located at the rear portions 175 (e.g., the bottom of the hinge posts 40 are fully seated on the upper surface 225 of the elongated toilet bowl 15).

In addition, a ratio of the maximum length 270 of the elongated toilet bowl 15 to the maximum length 140 of the toilet seat 35 is between about 1.08 and about 1.17. A ratio of the maximum width 275 of the elongated toilet bowl 15 to the maximum width 145 of the toilet seat 35 is between about 0.99 and about 1.05. A ratio of the maximum length 270 of the elongated toilet bowl 15 to the maximum length 195 of the elongated apertures 155 is between about 11.25 and about 14.12.

When the toilet seat assembly 10 is coupled to the round toilet bowl 20 (FIG. 8), the toilet seat 35 is slidable in a direction parallel to the longitudinal axes 165 of the elongated apertures 155 to position the fasteners 25 adjacent the front portions 170 of the elongated apertures 155. In this configuration, the central opening 75 of the toilet seat 35 is again completely inboard of the central opening 290 of the round toilet bowl 20. In other words, the apexes 105, 110, 115 of the inner edge 65 of the toilet seat 35 are positioned within the inner edge 285 of the round toilet bowl 20 when viewed in the reference frame of FIG. 8. In addition, the front apex 130 of the outer edge 70 of the toilet seat 35 is positioned rearward of the front apex 315 of the outer edge 295 of the round toilet bowl 20, and the side apexes 135 of the outer edge 70 of the toilet seat 35 are positioned rearward of the side apexes 320 of the round toilet bowl 20 in a direction along the longitudinal axes 165. As such, a portion of the upper surface 280 of the round toilet bowl 20 adjacent the front 310 of the round toilet bowl 20 extends beyond the outer edge 70 of the toilet seat 35 when viewed in the reference frame of FIG. 8. In other embodiments, the front apex 130 of the outer edge 70 of the toilet seat 35 can be positioned forward of the front apex 315 of the outer edge 295 of the round toilet bowl 20 by sliding the toilet seat 35 and the hinge posts 40 relative to the fasteners 25 toward the front 310 of the round toilet bowl 20. In addition, the hinge posts 40 are sized such the hinge posts 40 do not interfere with a tank (not shown) of the round toilet bowl 20 when the fasteners 25 are located at the front portions 170. Moreover, as the elongated apertures 155 overlap with the hinge assembly 28 (e.g., the attachment arms 95) of the toilet seat assembly 10, a portion of the fasteners 25 are positioned directly below the hinge assembly 28 (e.g., the attachment arms 95) of the toilet seat assembly 10 when the fasteners 25 are adjacent the front portions 170 of the elongated apertures 155. In other words, sufficient clearance is provided between the attachment portion 90 and the elongated apertures 155 such that the fasteners 25 can slide and be positioned under the hinge assembly 28 (e.g., the attachment portion 90) without interfering with the toilet seat 35 and/or the toilet lid 30 moving about the pivot axis 45.

In addition, a ratio of the maximum length 325 of the round toilet bowl 20 to the maximum length 140 of the toilet seat 35 is between about 0.99 and about 1.08. A ratio of the maximum width 330 of the round toilet bowl 20 to the maximum width 145 of the toilet seat 35 is between about 1.00 and about 1.05. A ratio of the maximum length 325 of the round toilet bowl 20 to the maximum length 195 of the elongated apertures 155 is between about 10.33 and about 13.02.

Figure 9:
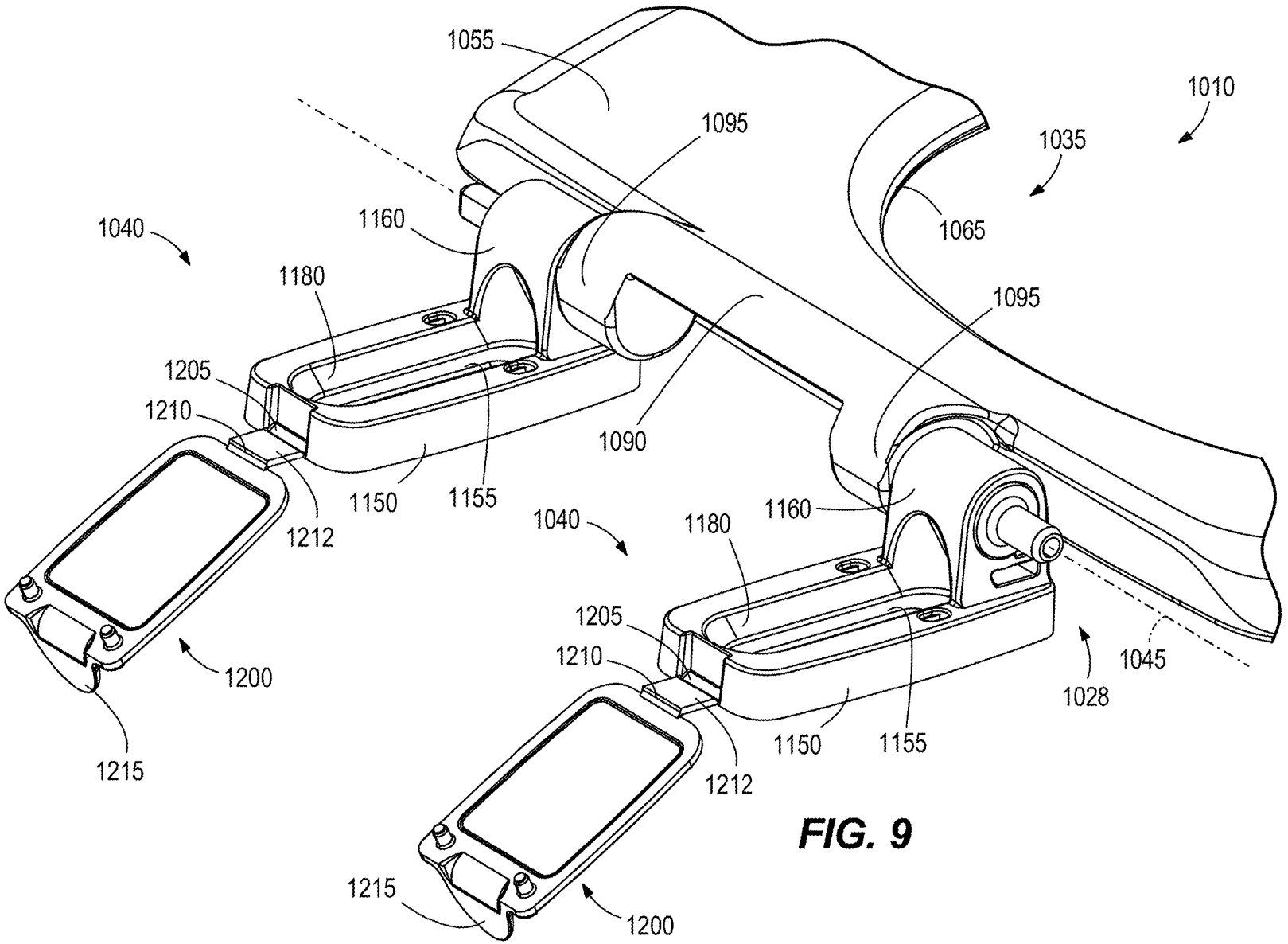
FIG. 9 is a perspective view of a toilet seat assembly including a toilet seat and hinge posts in accordance with another embodiment of the invention.

FIG. 9 illustrates a toilet seat assembly 1010 according to another embodiment of the invention. The toilet seat assembly 1010 includes a hinge assembly 1028, but is otherwise similar to the toilet seat assembly 10 described above with reference to FIGS. 1-8, with like components being shown with like reference numerals plus 1000. Differences between the toilet seat assembly 10, 1010 are described below.

As shown in FIG. 9, the toilet seat assembly 1010 includes the hinge assembly 1028 pivotably coupling a toilet lid (not shown) and a toilet seat 1035 to hinge posts 1040. Specifically, the toilet seat 1035 includes an attachment portion 1090 including two attachment arms 1095 that couple to the hinge posts 1040, and more particularly, to the upright portions 1160. Similarly, the toilet lid includes two attachment arms (not shown) that couple to the hinge posts 1040, and more particularly, to the upright portions 1160. The hinge assembly 1028 includes the attachment portion 1090 of the toilet seat 1035, the attachment arms of the toilet lid, and the upright portions 1160 of the base 1150. In the illustrated embodiment, the upright portions 1160 generally align with the elongated apertures 1155. For example, the longitudinal axis 165 of each elongated aperture 1155 aligns with the upright portion 1160 of the base 1150. In addition, the hinge assembly 1028 (e.g., the upright portions 1160) at least partially overlap with the elongated apertures 1155 in a direction parallel to the longitudinal axes 165. In particular, the hinge assembly 1028 (e.g., the upright portions 1160) overlap with the through apertures 190 of the hinge posts 40 in a direction parallel to the longitudinal axes 165. Stated another way, a portion of the elongated apertures 1155 are positioned directly below the hinge assembly 1028 (e.g., the upright portions 1160) at least when the toilet seat 1035 is in the lowered position on the toilet bowl 1015, 1020.

As shown in FIG. 9, each hinge post 1040 includes a cover 1200 that is movably coupled to the base 1150 by a first living hinge joint 1205 and a second living hinge joint 1210 to selectively cover the elongated aperture 155. An extension tab 1212 is positioned between the first and second living hinge joints 1205, 1210. In some embodiments, the cover 1200 may be coupled to the base 1150 by a single living hinge joint. Alternatively, the cover 1200 may be movably coupled to the base 1150 by other types of hinges. In the illustrated embodiment, the first and second living hinge joints 1205, 1210 are perpendicular to the longitudinal axis 165 of the corresponding elongated aperture 155. The cover 1200 includes a gripping tab 1215 extending upward from and perpendicular to the cover 1200 to allow a user to easily grasp and maneuver (e.g., pivot, etc.) the cover 1200 relative to the base 1150. The cover 1200 is positioned relative to the base 1150 such that a front portion (i.e., distal end opposite the living hinge 1210) of the cover 1200 overlaps with the hinge assembly 1028 (e.g., the upright portions 1160). Accordingly, the covers 1200 are at least partially disposed directly underneath the hinge assembly 1028 (e.g., the upright portions 1160) as the covers 1200 move about their first and second living hinge joints 1205, 1210 to cover the elongated apertures 1155.

Figure 10:
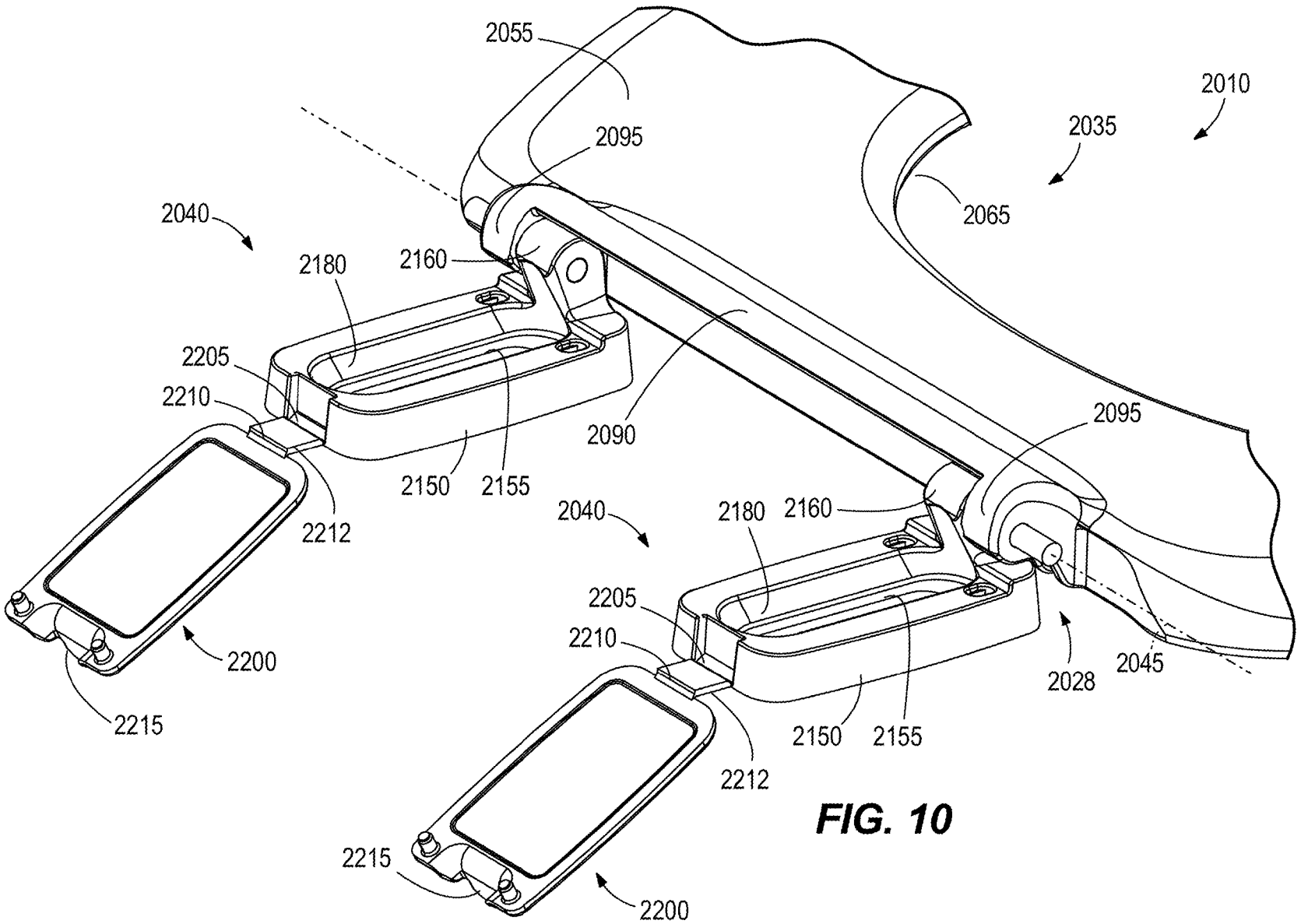
FIG. 10 is a perspective view of a toilet seat assembly including a toilet seat and hinge posts in accordance with yet another embodiment of the invention.

FIG. 10 illustrates a toilet seat assembly 2010 according to another embodiment of the invention. The toilet seat assembly 2010 includes a hinge assembly 2028, but is otherwise similar to the toilet seat assembly 1010 described above with reference to FIG. 9, with like components being shown with like reference numerals plus 1000. Only difference between the hinge assembly 1028 and hinge assembly 2028 is that the attachment arms 2095 of the toilet seat 2035 couple to the outside of the upright portions 2160 rather than the inside.

Various features of the invention are set forth in the following claims.

What is claimed is:

1. A toilet seat assembly comprising:

a toilet seat having a top surface and a bottom surface, the top surface configured to support a user on a toilet bowl while the bottom surface engages a surface of the toilet bowl;

a hinge post coupled to the toilet bowl via a fastener and having an elongated slot defining a longitudinal axis; and a hinge assembly pivotably coupling the toilet seat to the hinge post about a pivot axis that is perpendicular to the longitudinal axis, wherein the hinge post further includes an upright portion that is part of the hinge assembly, and wherein the the upright portion couples to the toilet seat and at least partially overlaps the elongated slot of the hinge post in a direction along the longitudinal axis of the elongated slot.

2. The toilet seat assembly of claim 1, further comprising a toilet seat lid pivotably coupled to the toilet seat and the hinge post via the hinge assembly.

3. The toilet seat assembly of claim 1, wherein the hinge assembly includes an attachment portion, wherein the attachment portion extends away from the toilet seat and at least partially overlaps the elongated slot of the hinge post in the direction along the longitudinal axis of the elongated slot.

4. The toilet seat assembly of claim 3, wherein the attachment portion at least partially overlaps a through aperture of the elongated slot in the direction along the longitudinal axis of the elongated slot.

5. The toilet seat assembly of claim 1, wherein the upright portion at least partially overlaps a through hole of the elongated slot in the direction along the longitudinal axis of the elongated slot.

6. The toilet seat assembly of claim 1, wherein the hinge post further includes a cover that is moveably coupled to a base of the hinge post, wherein the cover is moveable relative to the base to selectively cover the elongated slot.

7. The toilet seat assembly of claim 6, wherein the cover is coupled to the base of the hinge post via a living hinge.

8. A toilet seat assembly comprising:

a toilet seat; and a hinge post configured to pivotably support the toilet seat relative to a toilet bowl, the hinge post including a base having an elongated slot configured to receive a fastener to couple the hinge post to the toilet bowl, and a cover movably coupled to the base by a first living hinge, the cover including a first portion, a second portion, and a second living hinge positioned between the first and second portions, wherein the first portion is coupled to the base by the first living hinge, wherein the second living hinge enables the first and second portions of the cover to move relative to each other, and wherein the cover selectively covers the elongated slot in response to moving the cover about the first living hinge and the second living hinge.

9. The toilet seat assembly of claim 8, wherein the first living hinge and the second living hinge extend parallel to a longitudinal axis of the elongated slot.

10. The toilet seat assembly of claim 8, wherein the first living hinge and the second living hinge extend perpendicular to a longitudinal axis of the elongated slot.

11. The toilet seat assembly of claim 8, further comprising a hinge assembly pivotably coupling the toilet seat to the hinge post about a pivot axis that is perpendicular to the longitudinal axis, wherein the hinge assembly at least partially overlaps the elongated slot of the hinge post in a direction along a longitudinal axis of the elongated slot.

* * * * *